US006192842B1

(12) United States Patent
Haag

(10) Patent No.: US 6,192,842 B1
(45) Date of Patent: Feb. 27, 2001

(54) VALVE TIMING CONTROL APPARATUS OF AN INTERNAL COMBUSTION ENGINE

(75) Inventor: Michael Haag, Nürnberg (DE)

(73) Assignee: Ina Wälzlager Schaeffler oHG, Herzogenaurach (DE)

( * ) Notice: Subject to any disclaimer, the term of this patent is extended or adjusted under 35 U.S.C. 154(b) by 0 days.

(21) Appl. No.: 09/413,394

(22) Filed: Oct. 6, 1999

(30) Foreign Application Priority Data

Oct. 8, 1998 (DE) ..... 198 46 354

(51) Int. Cl.[7] ..... F01L 1/344

(52) U.S. Cl. ..... 123/90.17; 123/90.31; 74/568 R

(58) Field of Search ..... 123/90.15, 90.17, 123/90.31; 74/568 R; 464/1, 2, 160

(56) References Cited

U.S. PATENT DOCUMENTS

| | | | | |
|---|---|---|---|---|
| 5,078,647 | * | 1/1992 | Hampton | 464/1 |
| 5,172,662 | * | 12/1992 | Hampton | 123/90.17 |
| 5,234,088 | * | 8/1993 | Hampton | 192/44 |
| 5,235,941 | | 8/1993 | Hampton | 123/90.17 |

FOREIGN PATENT DOCUMENTS

| | | |
|---|---|---|
| 40 34 406 C2 | 5/1991 | (DE) . |
| 40 41 943 C2 | 6/1991 | (DE) . |
| 42 37 472 C1 | 3/1994 | (DE) . |
| 2 248 098 | 3/1992 | (GB) . |

* cited by examiner

*Primary Examiner*—Wellun Lo
(74) *Attorney, Agent, or Firm*—Henry M. Feiereisen

(57) ABSTRACT

A valve timing control apparatus for adjusting a rotational relation of a camshaft relative to a drive unit of an internal combustion engine, includes a clutch unit positioned between the drive unit and the camshaft and including first and second sections connected to the camshaft and movable relative to one another. A freewheel mechanism is placed between the first and second sections, whereby the first and second sections and the freewheel mechanism form each a clamping surface for interaction with confronting surfaces of the camshaft and the drive unit. The clutch unit is actuated by a force-applying unit such as to permit a movement of the camshaft relative to the drive unit from the base position in two opposite directions to respective end positions commensurate with two switching positions, wherein in the base position, the clamping surfaces of the first and second sections is in fixed rotative engagement with the confronting surfaces of the drive unit, thereby blocking a movement of the camshaft relative to the drive unit, whereas in the end positions, the freewheel mechanism so interacts with the confronting surfaces of the camshaft and the drive unit that a movement of the camshaft in one direction is blocked while a movement of the camshaft in the other direction is cleared to allow a changing moment acting on the camshaft to move the camshaft.

23 Claims, 3 Drawing Sheets

VALVE TIMING CONTROL APPARATUS OF AN INTERNAL COMBUSTION ENGINE

CROSS-REFERENCES TO RELATED APPLICATIONS

This application claims the priority of German Patent Application Serial No. 198 46 354.5, filed Oct. 8, 1998, the subject matter of which is incorporated herein by reference.

BACKGROUND OF THE INVENTION

The present invention relates to a valve timing control apparatus of an internal combustion engine.

German Pat. No. DE 40 41 943 C2 describes a valve timing control apparatus for internal combustion engines, including a clutch unit for coupling a driving timing pulley with a driven camshaft. Two plungers, each surrounded by a spring, are operated by a swivel arm, coupled to the camshaft, for movement in axial direction. Each spring has one end which is connected to a hydraulically operated slide. Upon adjustment of the slides in a first displacement direction, one spring turns and detaches from the plunger whereas an adjustment in a second displacement direction effects a turning of the other spring and detachment thereof from the associated plunger. As a result of the detachment, the swivel arm can move relative to the timing pulley in one direction until a spring winding lies in a respective groove, so that the spring windings occupy a slanted disposition and prevent a further displacement of the plunger as a consequence of increased friction forces between spring and plunger.

German Pat. No. 40 34 406 C2 discloses a valve timing control apparatus which includes two devices between a driving chain wheel and a driven camshaft, with each device having a substantially smooth pair of boundary surfaces. Adjustment of the rotation angle between the camshaft and the chain wheel is realized by rolling a boundary surface of one of these smooth pairs of boundary surfaces through hydraulic means upon the respectively associated boundary surface until reaching a stop member, or the boundary surface of one of these smooth pairs of boundary surfaces is axially shifted at an angle of inclination with respect to the surface. The boundary surface of the second device, providing the adjustment in the opposite direction, is "pulled along".

British Pat. No. GB 2 248 098 A describes a valve control apparatus for internal combustion engines, including an axially movable hollow actuating element having a bore through which a spring-biased ball projects into a groove formed in a rotatable second element connected to the camshaft. The groove is arranged at an angle with respect to the direction of displacement of the actuating element, so that a displacement of the actuating element results in a rotation of the second element. The second element is coupled with a plurality of circumferential clamps, with rollers being disposed in circumferential direction between the clamps at a distance with is kept constant by the clamps. The rollers are guided externally upon an inner cylindrical surface, which is coupled with a driving timing pulley, and internally by surfaces which are arranged along the circumference of an element, coupled to the camshaft, at an inclination relative to the tangent of this circumference. The inclination of these surfaces is provided in opposite direction with respect to two neighboring circumferential rollers. Thus, a displacement of the actuating element in a first direction in opposition to the force of a spiral spring results in an adjustment of the rotation angle in one direction until the rollers, inclined in one direction, are wedged between the inclination and the inner cylindrical surface. A release of the actuating element realizes a relative rotation in opposite direction until the rollers associated to the respective inclination are wedged accordingly.

A further valve control apparatus is known from U.S. Pat. No. 5,235,941 which operates similar to the valve control apparatus described in British Pat. No. GB 2 248 098 and also uses a plurality of roller pairs, whereby a respective roller is so jammed in the end positions of the travel path toward the camshaft in radial direction, that the driving timing pulley and the driven camshaft are in fixed rotative engagement. No jamming of the rollers occurs in the area between these end positions, so that the rotational relation between the camshaft and the timing pulley can be adjusted.

Although a configuration of valve control apparatuses based on a jamming action of the rollers in the extreme end positions seems to be sound because the overall structure can be kept comparably small, their manufacture is not cost-efficient and pose the risk of an excessive jamming of the rollers in their end positions when, for example, the clamping areas become contaminated or corroded, or when excessive load moments are applied, so that an adjustment is no longer possible. Moreover, there is a risk that the rollers or of their running or clamping surfaces deform as a consequence of applied fairly high clamping loads over an extended time, so that the precision of the adjustment is adversely affected. Prevention and elimination of these defects, created during extended exposure to loads, require therefore exchangeability of respective, cost-intensive components.

SUMMARY OF THE INVENTION

It is thus an object of the present invention to provide an improved valve timing control apparatus for an internal combustion engine, obviating the afore-stated drawbacks.

In particular, it is an object of the present invention to provide an improved valve timing control apparatus for an internal combustion engine, which is easy to manufacture and cost-efficient and yet reliable in operation while reducing maintenance and repair works.

These objects, and others which will become apparent hereinafter, are attained in accordance with the present invention by providing a clutch unit for effecting a fixed rotative engagement between the drive unit and the camshaft in a base position and two switching positions, with the clutch unit including first and second sections connected to the camshaft and movable relative to one another, and a resilient member placed between the first and second sections, wherein the first and second sections and the resilient member form each a clamping section for interaction with confronting surfaces of the camshaft and of the drive unit, and a force-applying unit for actuating the clutch unit to thereby realize a movement of the camshaft relative to the drive unit from the base position in two opposite orientations to respective end positions commensurate with the two switching positions, wherein in the base position, the clamping section of the first and second sections is in fixed rotative engagement with the confronting surfaces of the camshaft and the drive unit, whereas in the end positions, the clamping section of the resilient member is in fixed rotative engagement with the confronting surfaces of the camshaft and the drive unit.

In accordance with the present invention, a valve timing control apparatus is thus provided for switching of at least two different switching positions, including a clutch unit for temporary indirect and/or direct realization of a fixed rotative engagement between a drive unit and a camshaft in a friction and/or clamping type manner. The drive unit (or a component in fixed rotative connection with this drive unit) has at least a surface (hereinafter referred to as "first surface") which extends, at least partially, about a center axle of the camshaft, and may, for example, be formed by an outer or an inner surface area of a cylinder. Arranged on this first surface are at least one, preferably two, friction or clamping areas, contacted, preferably essentially non-rotatably, by the clutch unit (or a part of the clutch unit), when the clutch unit is engaged.

Also the camshaft, having cams which preferably realize the actuation of the gas exchange valves of an internal combustion engine, or an end section of the camshaft or an intermediate part securely fixed, directly or indirectly, with the camshaft, has at least a surface (hereinafter referred to as "second surface") which, at least partially, surrounds the center axle of the camshaft. The second surface may also have, at least partially, a cylindrical configuration and/or form part of a cylindrical surface, such as, for example, a part of an end section of a camshaft, or may be of tetragonal configuration or square configuration, with the clutch unit resting upon the second surface. The term "clutch unit" will denote the part of a clutch which includes a portion with only one clutch area of two clutch areas of which the clutch is composed (clutch half), or may refer to the entire clutch unit, including the mating clutch areas which preferably are formed by the first surface.

Suitably, the clutch unit rests against the second surface such that the second surface becomes invisible from outside in this area. A part of the clutch unit may be formed in one piece with the second surface, whereby the demarcation between the second surface and the clutch unit is realized functionally. However, a physical separation of the second surface from the clutch device is also possible, whereby one clutch half may be configured in the form of a cage which has a contact area of a contour representing, at least partially, substantially a negative image of the center axle of the camshaft. Connected to this contact area is a first and at least a second section, each of which having at least one friction or clamping area. The first and second sections may be directed outwardly. However, an inward deflection of the first and second sections may also possible and may be suitable when the camshaft, or an end section coupled therewith, is formed, at least partially, as hollow shaft having an interior in which a first surface, coupled to the drive unit, projects, with the first and second sections extending into direction of this first surface. Suitably, the area of the clutch unit, resting upon the second surface, is permanently coupled in fixed rotative engagement with the second surface. This connection can, for example, be realized through welding, bracing or screw fasteners.

According to another aspect of the present invention, the first and second surfaces are suitably so arranged relative to one another that the distance between the first surface and the center axle along an imaginary line extending radially outwards from the center axle at any location and any rotation angle, is greater than the distance between the second surface and the center axle.

According to another feature of the present invention, the first and second sections of the clutch are movable, at least partially, relative to one another. This is true in particular for the sections which contact the first surface when the clutch is engaged. The clutch unit may include flexible and/or elastic elements, with the first section and/or the second section exhibiting flexible or elastic characteristic.

The contact areas are suitably arranged on the first surface confronting end regions of the first and second sections. These contact areas, preferably representing friction areas or clamping areas, suitably correspond to the remaining first and second sections as far as material composition is concerned. Preferred are separate friction linings which may be detachably secured. The same applies for the first surface and their contact sections.

The rotation-fixed clamping or friction stage is realized through controlled movement of the contact areas of the first and/or second sections relative to the first surface, and/or through controlled movement of the contact area of the first section relative to the second section. Hereby, the contact area of the first section or second section moves relative to the corresponding mating contact area of the first surface from an essentially disengaged position to an engaged position, with the relative paths of movement of the first surface and first section or second section intersecting such that the first and second sections bear upon the first surface in such a manner that the drive unit and the camshaft are in fixed rotative engagement. Suitably, the movement of the first section and of the second section are coupled. Preferably, the respective movement paths of the contact areas of the first and second sections are different, i.e. at least mirror images of one another when considering the orientation. The engaged stage suitably represents the base position in which no external energy is applied for maintaining the engaged stage. A "kinematic reversal" is also possible when the first and second sections realize the engaged stage in conjunction with the first surface which is in fixed rotative engagement with the camshaft.

A valve timing controlled apparatus according to the invention is advantageous as it allows the use of simple components while, at the same time, the number of required components can be reduced. Moreover, the lift travels are reduced compared to conventional apparatuses. A secure connection can be realized even at high oil temperatures, so that oscillations are prevented. Also the use of simple oil valves and infinitely variable selection of an adjustment position are possible. The need for a locking system during starting phase to prevent vibrations of system, when the oil pressure has not been fully built-up yet, can be avoided as the provision of clamping bodies in a valve timing controlled apparatus according to the invention allows an adjustment only at sufficient oil pressure, or interrupts any adjustment when the oil supply breaks down.

According to another aspect of the present invention, the adjustable rotation angle of the camshaft with respect to the drive unit can be randomly selected. The magnitude of the rotation angle is not limited by the configuration of the clutch unit. However, it may be suitable to limit the travel path, independently from the clutch, through provision of a stop mechanism.

According to another feature of the present invention, the clutch unit includes two clutch halves, with at least one clutch half, preferably, however, both clutch halves, being provided of single-piece configuration. For example, one of the clutch halves, in fixed rotative engagement with the driveshaft, is formed of cylindrical structure with ring sector like cross section in axial direction, whereby the ring sector end sections are extended by outwardly directed, for example radially oriented, flanged projections. The second section may be formed of cylindrical configuration and may be extended on one circumferential area by an inwardly directed flange which is directed in substantially radial direction. The cylindrical sections are suitably aligned in concentric relationship. It will be appreciated by persons skilled in the art that the term "clutch half" should not be limited such that the halves necessarily complement each other to 100% or that each half represents 50%.

According to another feature of the present invention, the first section and/or second section extend each substantially parallel to a plane which parallels the center axle. Suitably, the planes are arranged at an angle. According to another aspect of the invention, the first and second sections may respectively be directed essentially radially to the center axle.

According to another aspect of the present invention, the friction or clamping area or contact area of the first section and/or the friction area or clamping area or contact area of the second section bear in engaged stage upon their respective mating contact areas such that the resultant contact or friction force upon the first section and/or the resultant contact or friction force upon the second section and/or the resultant contact or friction force acting as a whole upon the friction or contact area is directed radially to the center axle. Suitably, the contact or friction areas of the first and/or second sections are so arranged as to execute a movement with radial and tangential portion with respect to the center axle during the switching or coupling process.

According to another aspect of the present invention, the clutch unit includes an adjusting device for changing the coupling stage between an engaged position and a disengaged position. This adjusting device may be realized by a control unit, for example a control unit with memory and/or detector for storing and/or registering vehicle parameters such as engine parameters, and may include at least one hydraulic unit and/or electromagnetic unit. Suitably, the hydraulic unit and/or electromagnetic unit interact, at least partially and at least temporarily, with a freewheel unit which includes at least one spring element and/or at least one, preferably at least two, freewheel elements such as rollers. Suitably, the adjusting device and the clutch unit includes at least two freewheels (double-acting freewheel mechanism) operating in opposition to one another. The double-acting freewheel mechanism may include two rollers, guided in a common groove or in separate grooves and braced by a spring, preferably a compression spring, and pressed in the base position into clamped position. Each freewheel of the double-acting freewheel mechanism may be designed in any suitable manner known to the artisan. In the base position, the respective rollers are acted upon only by the spring element and urged into the clamped position, whereby each one roller is supported by the first section, and the other roller is supported by the second section. Thus, these sections are loaded in opposite orientation. The sections yield to this load as long as their respective contact areas are in fixed rotative engagement with the contact areas of the first surface, i.e. realize a connection which effects a fixed rotative engagement of the drive unit with the camshaft. The rollers are in clamped position only when the connection of the contact area is so secure that a transmission of occurring forces or moments is sufficient (base position).

According to another feature of the present invention, the force-applying unit for application of a force to clear one or the other roller for permitting an adjustment of the camshaft relative to the drive unit may be designed as a hydraulic system or as electromagnetic unit. As soon as an engine control unit, linked to the force-applying unit, generates a control signal according to a characteristic empirically determined on the basis of engine parameters, a force is applied upon the first or second section, depending on the rotation angle of the camshaft relative to the drive unit in a first or second orientation, as predetermined by the control characteristic, in a first orientation. The use of an electromagnetic unit in this context is advantageous as the need for a hydraulic system is no longer necessary.

It should be noted that the first orientation of the adjusting force and the first orientation of the rotation angle adjustment need not necessarily be directed in the same direction but depends from mechanical linkages. The same is true for the second orientation. By way of example, the force-applying unit operates as follows: Starting from the base position of the clutch unit, the valve timing of the internal combustion engine is adjusted in a first direction by having the force-applying unit apply a force or moment upon the first section which force or moment is directed by the first section toward the first freewheel element. As a consequence of this force, the freewheel element and the first section move conjointly in a first orientation, with the second section following this movement in view of its linkage to the first section. Certain differences in the movement pattern of the second section are caused by the flexibility of the first section with respect to the second section. While the first freewheel element is cleared, the second freewheel element is clamped so that the second section separates from the second freewheel element, and the spring unit is under pressure, thereby shortening the momentary spring length. As the second section is therefore no longer acted upon by a spring force and as the spring tension, which acts on the first section, is countered by a force, namely at least a portion of the superimposed force, the first section as well as the second section occupy a relaxed position, so that the clamping action against the respective mating friction areas and thus the fixed rotative connection between the drive unit and the camshaft is released. A force surplus of the superimposed force in relation to the momentary spring force results in a further displacement of the first and/or second section so that the rotation angle between drive unit and camshaft is changed. Suitably, the possible adjustment path is basically unlimited and depends, for example, on the duration of the pressure application. Thus, the intended adjustment path can be essentially randomly selected, although the arrangement of at least one stop member to restrict the feasible adjustment path may be appropriate. Relieve from the superimposed force releases also the spring so that the spring returns to its initial position, and the freewheel elements return to their starting position in which they bear upon the first and second sections to a greatest possible extent, thereby realizing again a fixed rotative engagement between the drive unit and the camshaft.

It should be noted that, for example, at a coupling between the first freewheel element and the second section as well as between the second freewheel element and the first section, the same adjustment can be substantially realized when, the application of a force from the first section upon the first freewheel element is substituted by the application of a force upon the second section which force is directed away from the second freewheel element. Change of valve timing in the opposite direction is realized by applying a force onto the respective other section.

According to another aspect of the present invention, the hydraulic unit is suitably positioned on the roller-distant surfaces of the first and second sections. Pressure chambers of the hydraulic unit are suitably formed within a cylindrical element, which has an inner cylindrical surface that forms the first surface, with the pressure chambers separated from one another by a partition wall which extends radially inwards from the inner cylindrical surface. Preferably, the partition wall is formed in one piece with the inner cylindrical surface. Each pressure chamber includes at least one supply port for supply and/or discharge of hydraulic oil to thereby build up and reduce the pressure in the chambers. Optionally, the supply and discharge may be realized through separate ports.

According to another aspect of the present invention, the electromagnetic unit fir applying a force onto the first and second sections includes at least one electromagnet, preferably two electromagnets, with one electromagnet being coupled to the first section and another electromagnet being coupled to the second section. As soon as an electromagnet is energized and interacts with the associated one or the first and second sections, a force is applied upon the respective section, whereby the cage is non-magnetic. It should be noted that the mentioned mobility between the first and second sections is ensured even when coupled to the camshaft in view of a certain flexibility of the sections. By electromagnetic force, the first or second section can be cleared from its respective clamped position to subsequently permit adjustment of the camshaft by the acting changing torque of the camshaft into one or the other orientation. Energizing of the electromagnets is suitably governed by a predetermined characteristic. Preferably, this characteristic changes after the release action to a pure angular adjustment.

According to another feature of the present invention, the double-freewheel mechanism is supported by a lobe which is suitably securely fixed to the camshaft. This lobe is suitably formed of one-piece configuration. The lobe may have a dovetailed cross-section and tapers in the direction of the camshaft or a cylindrical component that is in fixed rotative engagement with the camshaft. Suitably, the lobe is formed in one-piece with the camshaft or with the component attached to the camshaft.

According to another aspect of the present invention, the valve timing control apparatus may include an adjusting unit to adjust the tension of the spring of the double-acting freewheel mechanism and thus the distance between the freewheel elements in non-loaded state. This adjusting unit may include a set screw by which the tension of the spring can be controlled, for example, by adjusting the distance between two structural parts interacting with the two rollers in one-o-one correspondence. Persons skilled in the art will appreciate that numerous configurations of the adjusting unit are conceivable for adjusting the freewheel.

A valve timing control apparatus according to the invention allows a readjustment for setting (e.g. also in base assembly) of the distance of the contact or friction areas, or friction or the clamping force. This is advantageous, as the initial assembly is facilitated, on the one hand, and complex replacement of components is eliminated or at least delayed because of worn off friction areas when being subject to loads for an extended period. The bias of the spring elements can be set already during assembly. Thus, the admissible tolerances are positively influenced because they can be adjusted during assembly so that the manufacturing costs of these components are reduced.

According to another embodiment of the present invention, a valve timing control apparatus for effecting at least two different operating stages, includes at least one clutch unit for controlled and temporary effecting and/or releasing of a fixed rotative engagement between a drive unit and a camshaft, with the clutch unit including an intermediate device for realizing in one operating position a fixed rotative engagement in both rotation directions between the drive unit and the camshaft, wherein the intermediate device is coupled in at least one further operating position with one of the drive unit and the camshaft in fixed rotative engagement at least in one rotation direction, and is rotatable, at least temporarily, during switching between the two operating positions with respect to the drive unit and with respect to the camshaft.

Suitably, the intermediate device is a cage. The clutch unit thus permits three switching positions, i.e. a first switching position in which the camshaft and the drive unit are securely fixed together by the intermediate device (base position), a second switching position in which the intermediate device is securely coupled with respect to the camshaft at least in one rotation direction, and a third switching position in which the intermediate device is securely coupled with respect to the camshaft at least in a second rotation direction which is opposite to the first rotation direction. Suitably, the intermediate device extends from the camshaft to the drive unit, or between components which are in fixed rotative engagement with the camshaft and the drive adamant, respectively. The intermediate device may be of single piece configuration and is rotatable, preferably at a same time, with respect to the camshaft and the drive unit during switching operation.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
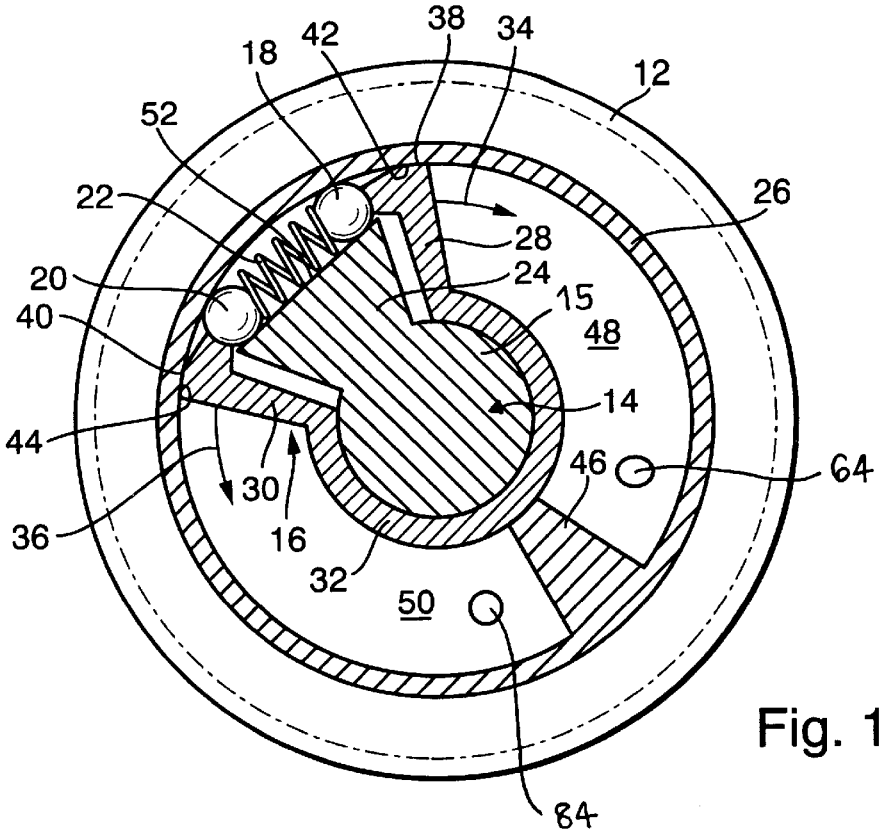
FIG. 1 is a schematic, partially sectional view, of one embodiment of a valve timing control apparatus according to the present invention in a first idle or base position.

Throughout all the Figures, same or corresponding elements are generally indicated by same reference numerals.

Turning now to the drawing, and in particular to FIG. 1, there is shown a schematic, partially sectional view, of one embodiment of a valve timing control apparatus according to the present invention, for adjusting a rotational relation between a camshaft 14 and a drive unit of an internal combustion engine and to thereby adjust the valve timing of gas exchange valves (not shown). For the sake of simplicity, the valve timing control apparatus will be described hereinafter only in connection with those parts that are necessary for the understanding of the present invention. It will be further appreciated by persons skilled in the art that the principle of the present invention as embodied in the valve timing control apparatus, illustrated in the drawing, is equally applicable for use in other devices such as, e.g., machine tools.

Although not shown in the drawing, the camshaft 14 is rotatably supported in a cylinder head and includes a solid center axle 15 of substantially circular configuration and a lobe 24 which is securely fixed to and extends out from the center axle 15 of the camshaft 14 and has a generally dovetailed cross section. The drive unit includes a timing pulley 12 which is covered on the side by a dome-shaped cover 26, fixedly secured to the timing pulley 12. A timing belt (not shown) is in mesh with the timing pulley 12 to transmit the driving force of the engine via a crankshaft (not shown) to the timing pulley 12 and thus to the camshaft 14 in order to operate the gas exchange valves. The drive unit further includes a cage, generally designated by reference numeral 32 and having two complementary sections 28, 30 arranged as mirror images of one another, with both sections 28, 30 partially circumscribing the center axle 15 of the camshaft 14. The cage sections 28, 30 exhibit a certain flexibility to thereby allow a relative mobility between the cage sections 28, 30, and have friction or clamping areas 38, 40 for interaction with mating clamping surfaces 42, 44 formed inwardly on the cover 26.

The valve timing control apparatus, shown in FIG. 1, occupies its first idle or base position, and includes a clutch unit, generally designated by reference numeral 16 and disposed between the timing pulley 12 and the camshaft 14. Thus, through operation of the clutch unit 16, the timing pulley 12 and thus the drive unit can be engaged with or disengaged from the camshaft 14. As indicated by arrows 60 and 80 (cf. FIGS. 2 and 3, respectively), the camshaft 14 can be shifted with respect to the timing pulley 12, when the clutch unit 16 is disengaged.

The clutch unit 16 is provided in the form of a double-acting freewheel mechanism which includes two spheres or rollers 18, 20 which are interconnected by a prestressed spring 22, extending between the rollers 18, 20. Suitably, the rollers 18, 20 and the spring 22 are accommodated in a groove of the lobe 24, with the rollers 18, 20 substantially received by the groove bottom 52. In the base position, shown in FIG. 1, the spring 22 exhibits its most relaxed state so that the rollers 18, 20 rest, at least temporary, against the ends of the spring 22 and are in rolling contact upon the confronting surface area 70 of the lobe 24 and upon the sections 28, 30 of the cage 32. As a consequence of the elasticity of the cage 32, the cage sections 28, 30 are pressed apart outwardly by the spring 22 in the direction of arrows 34, 36, respectively, so that the friction areas 38, 40 of the cage sections 28, 30 jam against the mating clamping surfaces 42, 44, thereby realizing a fixed rotative engagement between the camshaft 14 and the timing pulley 12. This fixed rotative engagement is realized as a result of a substantially fixed securement of the double-acting freewheel mechanism 16 with respect to the lobe 24. A moment is transmitted via the clamping interfaces 38, 42; 40, 44 onto the double-acting freewheel mechanism 16 and ultimately to the lobe 24 and thus camshaft 14 via the fixed connection between the double-acting freewheel mechanism 16 and the lobe 24, for example through wedging of the rollers 18, 20 in the rotation directions.

As further shown in FIG. 1, a partition wall 46 extends radially inwardly from an inside surface area 68 of the cover 26 to demarcate in conjunction with the cage 32 two chambers 48, 50 which form part of a hydraulic system. In the base position of the valve timing control apparatus, both chambers 48, 50 are effectively in a pressureless state, whereby the cage 32 acts here, for example, as a spring element. The chambers 48, 50 are fluidly connected to a pressure source for supply of a hydraulic fluid, such as hydraulic oil, whereby the hydraulic fluid enters the chamber 48 through a port 64 and enters the chamber 50 through a port 84.

Figure 2:
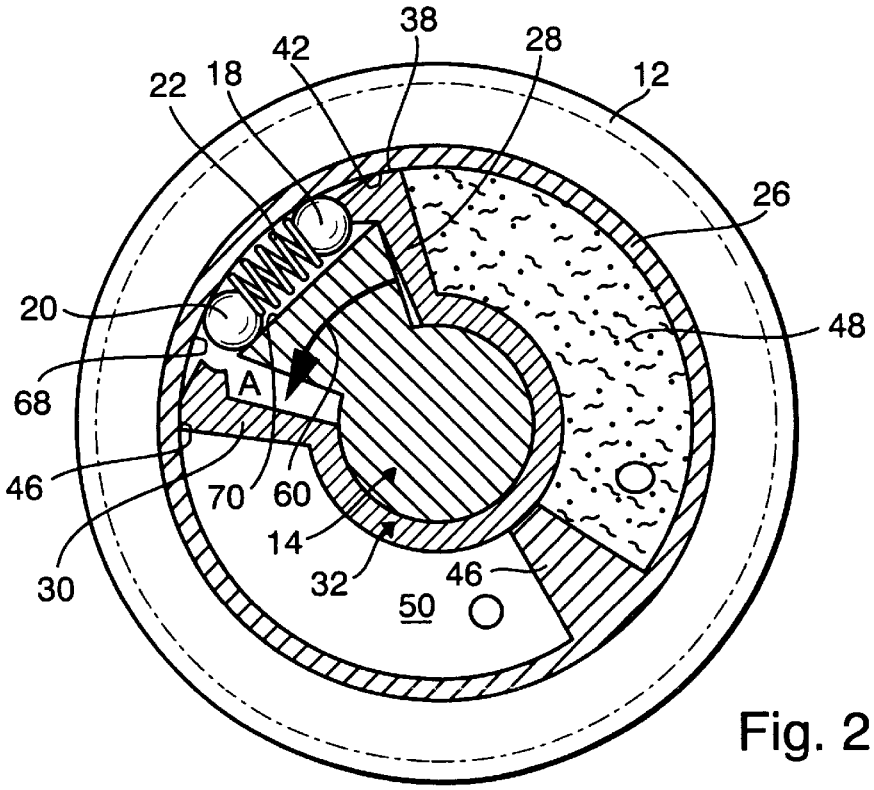
FIG. 2 is a schematic, partially sectional view, of the valve timing control apparatus of FIG. 1 in a second switching position.

FIG. 2 shows the valve timing control apparatus in a second switching position in which the rotational relation of the camshaft 14 relative to the timing pulley 12 is changed in the direction of arrow 60. Hydraulic fluid is fed through port 64 into the pressure chamber 48 which is thus under pressure, so that a force is applied against the cage section 28. As a result of this applied pressure, the cage section 28, is pushed in the direction, indicated by arrow 60, and disengages from the jammed connection with the mating clamping surface 42. Thus, the inward shift of the cage section 28 as a result of the force frees the roller 18 from its clamped position, thereby shortening the spring 22 and increasing the spring tension because the other roller 20 is jammed into a narrowing gap formed by the surface area 70 of the lobe 24 and the inside surface area 68 of the cover 26 and thus prevented from a displacement in the direction of the force application. In view of the single-piece configuration of the cage 32, the cage sections 28, 30 are coupled to one another, so that the cage section 30 conjointly moves in substantial conformity with the cage section 28, except for slight differences because of the elasticity, and separates from the confronting roller 20. Thus, the acting changing torque of the camshaft 14 effects a rotation of the camshaft 14 relative to the timing pulley 12 only in the direction of arrow 60 as a movement into the opposite direction is barred by the clamped position of the roller 20. Thus, when applying a force upon the cage section 28, the associated roller 18 is cleared while the opposite roller 20 is clamped, so that the changing torque of the camshaft can effect a rotation of the camshaft 14 only in the cleared direction, here in the direction A.

Figure 3:
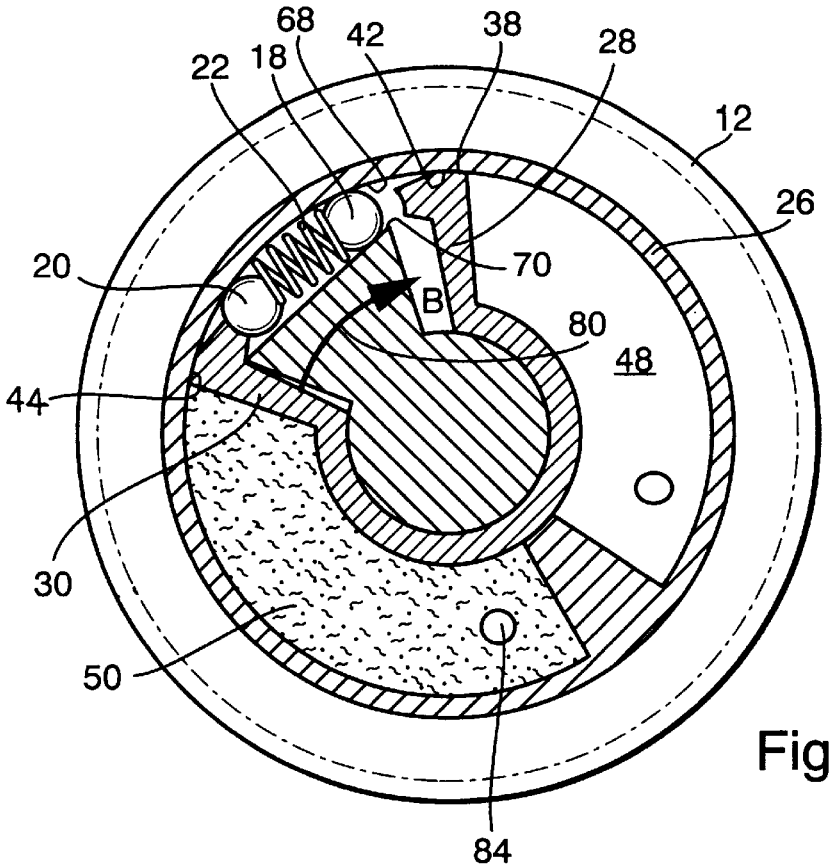
FIG. 3 is a schematic, partially sectional view, of the valve timing control apparatus of FIG. 1 in a third switching position.

FIG. 3 shows the valve timing control apparatus in a third switching position in which the rotational relation of the camshaft 14 relative to the timing pulley 12 is changed in the opposite direction, indicated by arrow 80. Hydraulic fluid is now fed through port 84 into the pressure chamber 50 which is thus under pressure, so that a force is applied against the cage section 30 which is now pushed to disengage from the jammed connection with the mating clamping surface 44. Thus, the inward shift of the cage section 30 frees the roller 20 and is accompanied by a conjoint movement of the cage section 28 which thus separates from the confronting roller 18. The spring 22 is shortened and the spring tension is increased as the roller 18 is prevented from a displacement in the direction of the force application by the converging surface areas 68, 70. Thus, the changing torque of the camshaft 14 effects a rotation of the camshaft 14 relative to the timing pulley 12 only in the direction of arrow 80.

Figure 4:
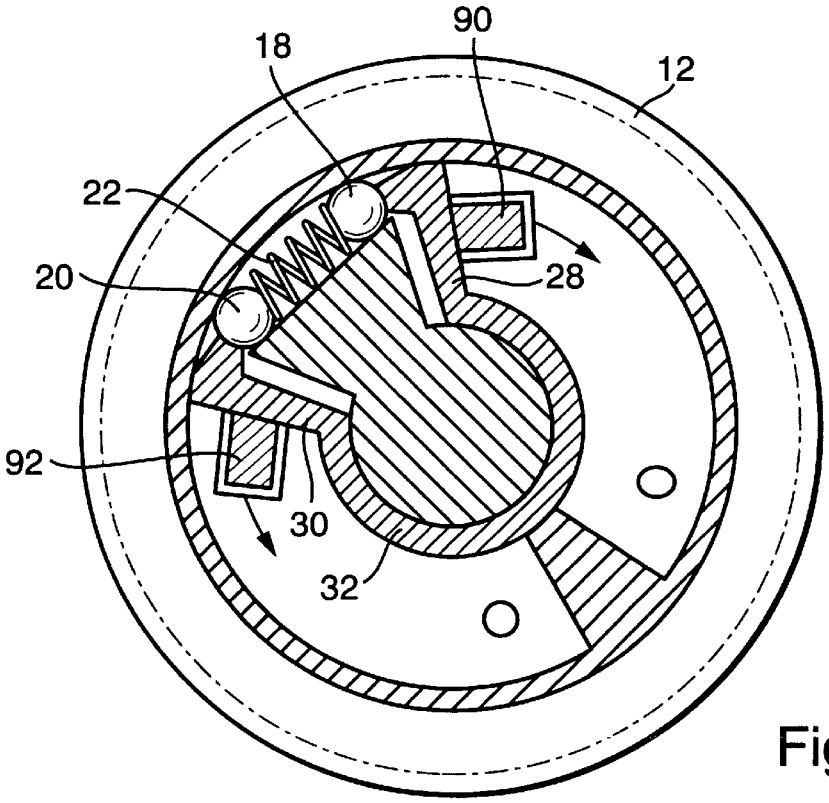
FIG. 4 is a schematic, partially sectional view, of another embodiment of a valve timing control apparatus according to the present invention in a first idle or base position.
Figure 5:
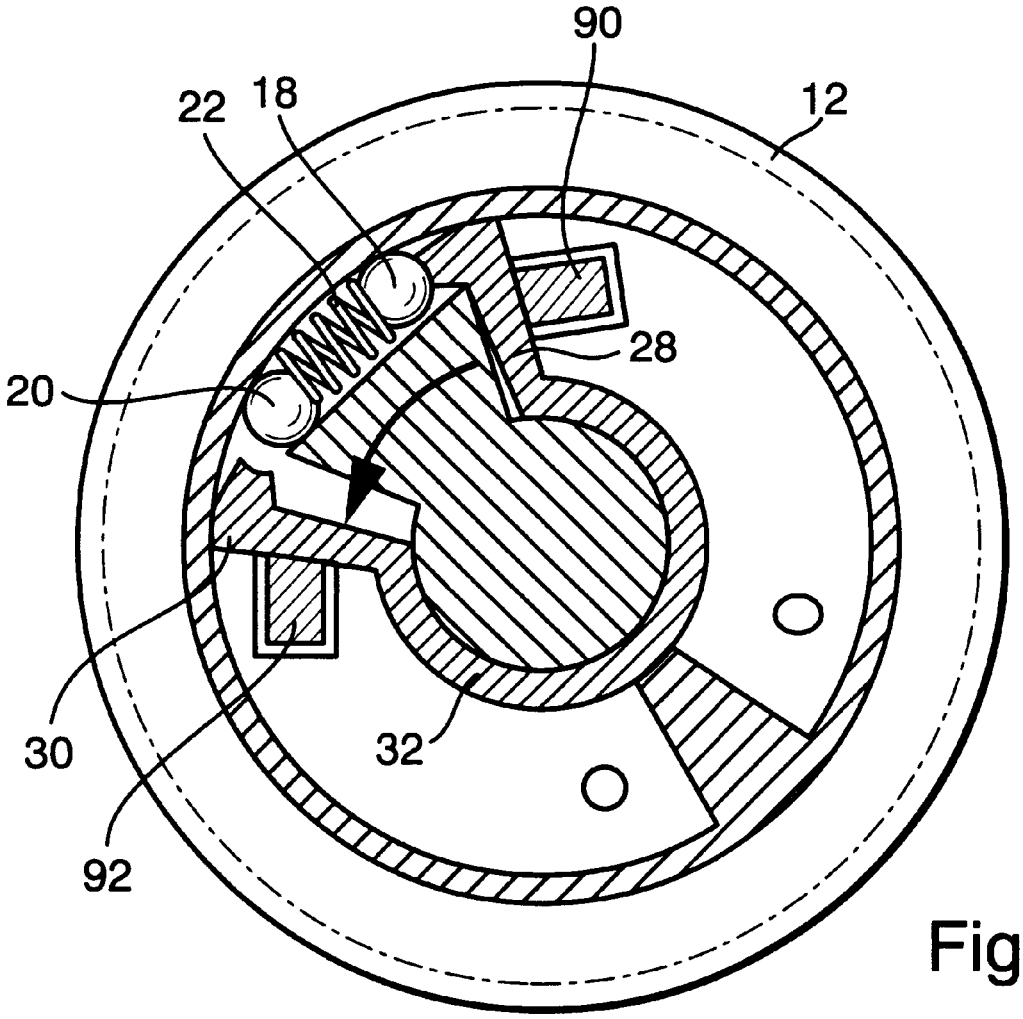
FIG. 5 is a schematic, partially sectional view, of the valve timing control apparatus of FIG. 4 in a second switching position.

Turning now to FIG. 4, there is shown a schematic, partially sectional view, of another embodiment of a valve timing control apparatus according to the present invention in the base position. Parts corresponding with those in FIG. 1 are denoted by identical reference numerals and not explained again. The valve timing control apparatus of FIG. 4 differs from the valve timing control apparatus of FIG. 1 in the manner of force application, which, according to FIG. 4, is realized by two electromagnets 90, 92, whereby the cage 32 is made of non-magnetic material. When adjusting the rotational relation of the camshaft 14 relative to the timing pulley 12 in the direction of arrow 60, as shown in FIG. 5, which corresponds to the second switching position as described with reference to FIG. 2 in conjunction with the valve timing control apparatus of FIG. 1, the electromagnet 90 is energized so that a magnetic field builds up between the camshaft 14 (magnetic) and the electromagnet 92. Thus, through attraction between the camshaft 14 and the electromagnet 90, the cage 32 is moved toward the lobe 24 of the camshaft 14. As a result, the roller 18 is cleared and the cage section 30 is separated from the roller 20 which is in clamped position. Thus, the changing moments of the camshaft 14 can only effect a movement of the camshaft 14 in the direction of arrow 60, in an analogous manner, as described with reference to FIG. 2. When de-energizing the electromagnet 90, the cage 32 and the rollers 18, 20 return automatically to the base position, in which the rollers are clamped by the spring 22. The adjustment of the camshaft 14 in opposite direction is realized by energizing the electromagnet 92.

While the invention has been illustrated and described as embodied in a valve timing control apparatus of an internal combustion engine, it is not intended to be limited to the details shown since various modifications and structural changes may be made without departing in any way from the spirit of the present invention.

What is claimed as new and desired to be protected by Letters Patent is set forth in the appended claims:

1. A valve timing control apparatus for adjusting a rotational relation of a camshaft relative to a drive unit of an internal combustion engine, comprising:

a clutch unit positioned between the drive unit and the camshaft and including first and second sections connected to the camshaft and movable relative to one another, and a freewheel mechanism placed between the first and second sections, said first and second sections and said freewheel mechanism forming each a clamping surface for interaction with confronting surfaces of the camshaft and the drive unit; and force-applying means for so actuating the clutch unit to permit a movement of the camshaft relative to the drive unit from a base position in two opposite directions to respective end positions commensurate with two switching positions, wherein in the base position, the clamping surfaces of the first and second sections is in fixed rotative engagement with the confronting surfaces of the drive unit, thereby blocking a movement of the camshaft relative to the drive unit, whereas in the end positions, the freewheel mechanism so interacts with the confronting surfaces of the camshaft and the drive unit that a movement of the camshaft in one direction is blocked while a movement of the camshaft in the other direction is cleared to allow a changing moment acting on the camshaft to move the camshaft.

2. The apparatus of claim 1 wherein at least one of the first and second sections is configured at least partially flexible or elastic.

3. The apparatus of claim 1 wherein the rotational relation between the camshaft relative to the drive unit is randomly adjustable.

4. The apparatus of claim 1 wherein the clamping surface of at least one of the first and second sections are curved with respect to a center axle of the camshaft.

5. The apparatus of claim 4 wherein the clamping surface of at least the one of the first and second sections is, at least partially, of circular configuration with respect to the center axle.

6. The apparatus of claim 1 wherein the first and second sections extend substantially parallel to a plane which parallels a center axle of the camshaft.

7. The apparatus of claim 1 wherein the first and second sections extend at an angle.

8. The apparatus of claim 1 wherein the clutch unit includes a substantially scissors-type clamping unit.

9. The apparatus of claim 1 wherein the first and second sections extend substantially radial with respect to the camshaft.

10. The apparatus of claim 1 wherein at least one of the clamping surface of the first section and the clamping surface of the second section so bears upon the confronting mating surface when the clutch unit is engaged that at least one of a resultant friction force upon the first section, a resultant friction force upon the second section and a resultant friction force acting as a whole upon the clamping surfaces, is oriented radial to a center axle of the camshaft.

11. The apparatus of claim 1 wherein at least one of the first and second sections has an end region forming the associated clamping surface, said end region being moveable in circumferential direction and having an adjustable radial distance to a center axle of the camshaft.

12. The apparatus of claim 1 wherein the clutch unit includes a cage which, at least partially, surrounds the camshaft, said first and second sections extending outwardly from the cage.

13. The apparatus of claim 12 wherein the first and second sections have outwardly directed ends for forming the associated clamping surfaces.

14. The apparatus of claim 11 wherein the radial mobility and the circumferential mobility of the end region are coupled.

15. The apparatus of claim 1 wherein the clamping surface of the first section is movable with respect to the clamping surface of the second section, wherein the confronting surface interacting with the clamping surface of the first section is fixed with respect to the confronting surface interacting with the clamping surface of the second section, so that the clamping surface of the first section is so displaced relative to the clamping surface of the second section area, when the clutch unit is engaged in the end positions, that the clamping surfaces are jammed with respect to their confronting surfaces.

16. The apparatus of claim 1 wherein the freewheel mechanism includes two rollers and a spring extending between the two rollers, with a first one of the rollers cooperating with the first section and a second one of the rollers cooperating with the second section, said freewheel mechanism interacting with the clamping surfaces of the drive unit and the camshaft as to define a double-acting freewheel mechanism.

17. The apparatus of claim 16 wherein the double-acting freewheel mechanism extends substantially circumferential direction between the first and second sections with respect to a center axle of the camshaft.

18. The apparatus of claim 16 wherein the rollers are in engagement with the first and second sections,when the clutch unit is in the base position, and wherein in one of the end positions, the first roller is out of engagement with the first section, and in the other one of the end positions the second roller is out of engagement with the second section.

19. The apparatus of claim 16 wherein the force-applying unit is an element selected from the group consisting of hydraulic means and electromagnetic means.

20. The apparatus of claim 19 wherein the hydraulic means includes a first pressure chamber arranged on a freewheel mechanism distal side adjacent to the first section and a second pressure chamber arranged on a freewheel mechanism distal side adjacent the second section for selectively applying pressure upon the first and second sections.

21. The apparatus of claim 16 wherein the double-acting freewheel mechanism is supported by a lobe of the camshaft.

22. The apparatus of claim 20 wherein the pressure in the pressure compartments is smaller than a predetermined limit pressure, when the clutch unit is in the base position, wherein the first section moves in a direction of the freewheel mechanism when a fluid pressure in the first pressure compartment builds up to engage the clutch unit in one of the end positions so that the second section is shifted in a same direction, thereby releasing the engagement between the second section and the freewheel mechanism as the second roller is jammed by a narrowing gap formed between the confronting surfaces of the drive unit and the camshaft to thereby effect a change of the rotational relation in the one direction between the camshaft and the drive unit by the changing moments acting on the camshaft, and wherein the second section moves in a direction of the freewheel mechanism when a fluid pressure in the second pressure compartment builds up to engage the clutch unit in the other one of the end positions so that the freewheel elements and the first section are shifted in a same direction, thereby releasing the engagement between the first section and the freewheel mechanism as the first roller is jammed by a narrowing gap formed between the confronting surfaces of the drive unit and the camshaft to thereby effect a change of the rotational relation in the one other direction between the camshaft and the drive unit by the changing moments acting on the camshaft.

23. The apparatus of claim 19 wherein the electromagnetic unit includes a first electromagnet coupled with the first section and a second electromagnet coupled with the second section, said first and second sections are forced apart by the freewheel mechanism into the base position in which the drive unit and the camshaft are in fixed rotative engagement when the first and second electromagnets are de-energized, wherein upon energizing the first electromagnet, a magnetic field is generated by which the first section is moved in the direction of the freewheel mechanism, with the second roller being jammed by a narrowing gap formed between the confronting surfaces of the drive unit and the camshaft to thereby effect a change of the rotational relation in the one direction between the camshaft and the drive unit by the changing moments acting on the camshaft, and wherein upon energizing the second electromagnet a magnetic field is generated by which the second section is moved in the direction of the freewheel mechanism, with the first roller being jammed by a narrowing gap formed between the confronting surfaces of the drive unit and the camshaft to thereby effect a change of the rotational relation in the other one of the directions between the camshaft and the drive unit by the changing moments acting on the camshaft.

* * * * *